US011939761B2

(12) United States Patent
Reinhart

(10) Patent No.: US 11,939,761 B2
(45) Date of Patent: Mar. 26, 2024

(54) POLYGONAL DRAINAGE CHANNEL SYSTEM AND METHOD

(71) Applicant: Gregory J. Reinhart, Alvada, OH (US)

(72) Inventor: Gregory J. Reinhart, Alvada, OH (US)

( * ) Notice: Subject to any disclaimer, the term of this patent is extended or adjusted under 35 U.S.C. 154(b) by 0 days.

(21) Appl. No.: 17/987,297

(22) Filed: Nov. 15, 2022

(65) Prior Publication Data

US 2023/0279653 A1 Sep. 7, 2023

Related U.S. Application Data

(60) Provisional application No. 63/316,480, filed on Mar. 4, 2022.

(51) Int. Cl.
*E02B 11/00* (2006.01)
*E03F 3/04* (2006.01)

(52) U.S. Cl.
CPC ..... *E03F 3/046* (2013.01); *E02B 11/005* (2013.01)

(58) Field of Classification Search
CPC ..... E02B 11/005
USPC ..... 405/36, 43–45, 47, 49
See application file for complete search history.

(56) References Cited

U.S. PATENT DOCUMENTS 444,564 A * 1/1891 Copeland
2,798,768 A * 7/1957 Babin ..... A01G 25/02 405/51
3,681,925 A * 8/1972 Schmunk ..... E02B 11/005 138/121
3,802,202 A 4/1974 Maroschak
3,878,685 A * 4/1975 Schmunk ..... F16L 11/111 138/121
3,926,222 A * 12/1975 Shroy ..... F16L 25/0063 138/155
4,020,639 A 5/1977 Nagare et al.
(Continued)

FOREIGN PATENT DOCUMENTS

DE 2459642 A1 * 7/1976
GB 2016639 * 9/1979
(Continued)

OTHER PUBLICATIONS

KR 102116480 B1, (Year: 2020).*
(Continued)

*Primary Examiner* — Sunil Singh
(74) *Attorney, Agent, or Firm* — Ward Law Office LLC; Jacob M. Ward

(57) ABSTRACT

A substantially polygonal drainage channel system is provided. The drainage channel can include a substantially polygonal cross-section that can have rounded corners or edges. More specifically, the cross-section of the drainage channel can be formed to resemble an "upside-down pear." The drainage channel can have a cross-sectional shape that can be created by first placing two circles of different diameters on top of one another. The "top" circle can be larger than the "bottom" circle. The two circles can then be connected with two tangential lines, one on each side, resulting in a shape in which a top of the drainage channel tapers down toward a bottom of the drainage channel. The drainage channel can also include ribs, drainage slots, and a connector-check valve. A method for installing a drainage channel is also provided.

12 Claims, 6 Drawing Sheets

(56) References Cited

U.S. PATENT DOCUMENTS

| | | | | | |
|---|---|---|---|---|---|
| 4,024,894 | A * | 5/1977 | Drossbach | F16L 11/118 | 138/121 |
| 4,704,047 | A * | 11/1987 | Oldfelt | E02B 13/00 | 405/37 |
| 4,930,936 | A | 6/1990 | Hegler et al. | | |
| 5,560,163 | A | 10/1996 | Carlton | | |
| 9,447,902 | B2 * | 9/2016 | Tendick | F16L 9/006 | |
| 2002/0172557 | A1 * | 11/2002 | Chen | E02B 11/005 | 405/50 |
| 2003/0031512 | A1 * | 2/2003 | Goddard | E03F 1/002 | 405/45 |
| 2006/0070658 | A1 | 4/2006 | Nakata et al. | | |
| 2009/0052990 | A1 * | 2/2009 | Richardson | A01G 25/06 | 405/43 |
| 2011/0174378 | A1 | 7/2011 | Leung | | |
| 2013/0315668 | A1 * | 11/2013 | Poerio | E03F 3/04 | 405/36 |
| 2015/0122366 | A1 * | 5/2015 | Tendick | F16L 1/036 | 405/178 |

FOREIGN PATENT DOCUMENTS

| | | | | |
|---|---|---|---|---|
| GB | 2016639 A | * | 9/1979 | |
| GB | 2016639 A | * | 9/1979 | E02B 11/005 |
| JP | 59-158818 A | * | 9/1984 | |
| JP | 5-202512 A | * | 8/1993 | |
| KR | 102116480 B1 | * | 5/2020 | |

OTHER PUBLICATIONS

DE 2459642 (Year: 1976).*

DE 3515477 A1 (Year: 1986).*

Written Opinion of the International Searching Authority dated Feb. 21, 2023.

ADS 4-In × 10-Ft Corrugated Perforated Pipe in the Corrugated Drainage Pipe Department at lowes.com.

Source 1 Drainage S1E-PLCD-3PK 3-Pack Trench & Driveway Channel Drain System with Grates—GreyDock.com.

* cited by examiner

Fig. 7A
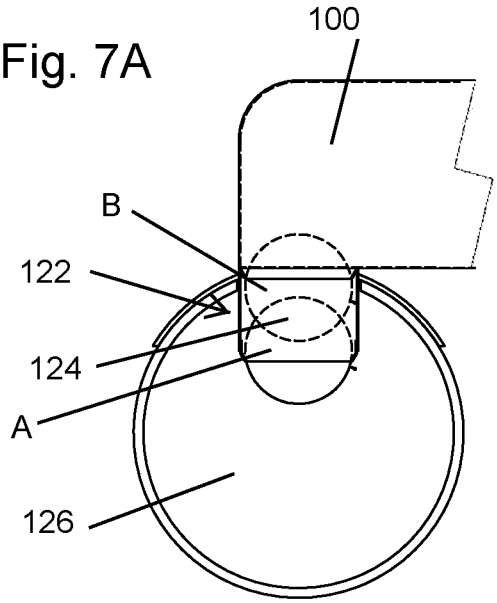
Fig. 7B
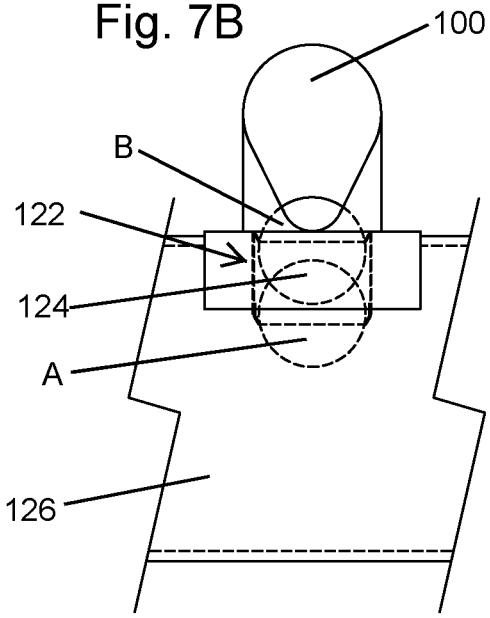
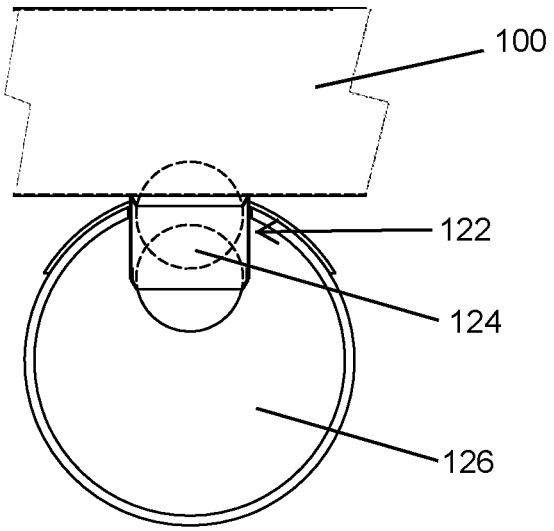
Fig. 7C

POLYGONAL DRAINAGE CHANNEL SYSTEM AND METHOD

CROSS-REFERENCE TO RELATED APPLICATIONS

This application claims the benefit of U.S. Provisional Application No. 63/316,480, filed on Mar. 4, 2022. The entire disclosure of the above application is incorporated herein by reference.

FIELD

The present technology relates to drainage systems and, more specifically, structure for use in drainage systems.

INTRODUCTION

This section provides background information related to the present disclosure which is not necessarily prior art.

It is desirable to remove excess water, surface or subsurface, in fields which are used for agricultural purposes, in order to prevent damage to crops, improve the condition of the soil, and permit earlier entrance onto fields after rainfall. Similar problems of water drainage are common to commercial and residential establishments. The conventional drainage solution is to provide a trench or plow corrugated pipe into the soil.

Over time, the systems for removing excess water have evolved. Originally, the drainage system was identified as tile, which could be made from clay. This term is still used today by some farmers. However, in the 1960s, as farming technology improved, the drainage system moved on from clay tile and began being manufactured from corrugated plastic. This type of drainage system has been identified as pipe and is used industry wide.

Current corrugated drainage channel has problems associated with the flow characteristics within the drainage channel due to a high Reynolds coefficient. The Reynolds coefficient is a calculation of the pressure drop and frictional losses within a system. The flow characteristics are impacted by the use of corrugations or ribs that give drainage channel external strength and flexibility (for installation), but also create extreme turbulence for the water flowing inside. This turbulence greatly reduces the carrying capacity (flowrate) of the pipe. Furthermore, the ribs create pockets of water that simply cannot drain. If this water includes sediment (suspended solids), which is likely, the sediment will settle out and in the absence of moisture, become hard within the drainage channel.

To further exacerbate the sedimentation problem, corrugated pipe has openings on the circumference of the pipe. This can allow soil to enter the pipe from the top and sides and can further impede the flow rate. This sedimentation build-up can severely restrict the flow of water, thus slowing the drainage speed of an agricultural field. Eventually the sediment within the tile can completely block the flow and draining of water through the pipe.

Another problem with corrugated pipe is that it can stretch during installation, especially on tile plows. If this happens, the ribs can become deformed, and the sidewall of the drainage channel can become stretched and weakened. The deformation of the drainage channel greatly reduces the strength of the corrugated pipe. If the stretch is too great, the tile then can collapse under the weight of the overburden, thus blocking the flow of water.

Accordingly, there is a need for a drainage channel that has the flexibility of corrugated drainage pipe without the problems relating to sedimentation and water flow rates.

SUMMARY

In concordance with the instant disclosure, drainage channel that has the flexibility of the corrugated drainage pipe without the problems such as sedimentation and water flow rates, has surprisingly been discovered.

In certain embodiments, a drainage channel, a polygonal structure with ribs, is provided that has a substantially polygonal cross-section, where the substantially polygonal cross-section be formed by a series of multiple lines in the shape of a curve. Examples further include where the substantially polygonal cross-section can include line segments joined by rounded corners or edges. The drainage channel can include a top surface, side surfaces, and a bottom surface. A plurality of ribs can be formed in the top surface and the side surfaces, and the bottom surface can include a plurality of drainage apertures.

The present disclosure further contemplates a method for installing a drainage channel. A drainage channel can be provided. The drainage channel, as described hereinabove, can include a substantially polygonal cross section, a top surface, a plurality of side surfaces and a plurality of ribs formed on the top surface and the plurality of side surfaces. The bottom surface can include a plurality of drainage openings. The drainage channel can be installed with the bottom surface oriented down.

In certain embodiments, a substantially polygonal drainage channel system is provided. The drainage channel can include a substantially polygonal cross-section that can have rounded corners or edges. More specifically, the cross-section of the drainage channel can be formed to resemble an "upside-down pear." The drainage channel can have a cross-sectional shape that can be created by first placing two circles of different diameters on top of one another. The "top" circle can be larger than the "bottom" circle. The two circles can then be connected with two tangential lines, one on each side, resulting in a shape in which a top of the drainage channel tapers down toward a bottom of the drainage channel.

The outer surface of the drainage channel can contain corrugation or ribs on the top surface and side surfaces and smooth bottom. The ribs can be formed as standard corrugation with a consistent shape or can be formed with different dimensions on the top surface and side surface. The shape and the pitch of the ribs can be modified. The ribs can be used to increase the compressive strength of the material, can allow for rolling the material during manufacturing and installation, and can allow the drainage channel to be bent without kinking. The bottom surface can include drain holes and/or slots.

The inclusion of the ribs on the top surface and side surface can create structural strength in an otherwise weak material and can allow the product to bend without cracking, stretching, or tearing during installation and use. Additionally, the top surface can be larger than the bottom surface. The larger profile for the top surface can allow for a larger volume of water to flow therethrough and can compensate for the additional turbulent flow created by the ribs. The shape of the drainage channel can also ensure proper orientation of the drainage channel within a trench during installation.

The drainage channel can also include a connector-check valve. In certain instances, the check valve can be automatic and not manual. The connector can be used to join the multiple drainage channels to the main drainage channel, and/or sub-main drainage channels. The connector can also include a check valve. The check valve can allow the water flow to be stopped by plugging the main outlet of the drainage channel and creating backpressure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 7A is front elevational view of a connector for connecting pieces of the substantially polygonal drainage channel according to one embodiment of the present disclosure;

FIG. 7B is a top plan view of a substantially polygonal drainage channel according to one embodiment of the present disclosure;

FIG. 7C is a front elevational view of a connector for connecting pieces of the substantially polygonal drainage channel according to another embodiment of the present disclosure;

DETAILED DESCRIPTION

Figure 1:
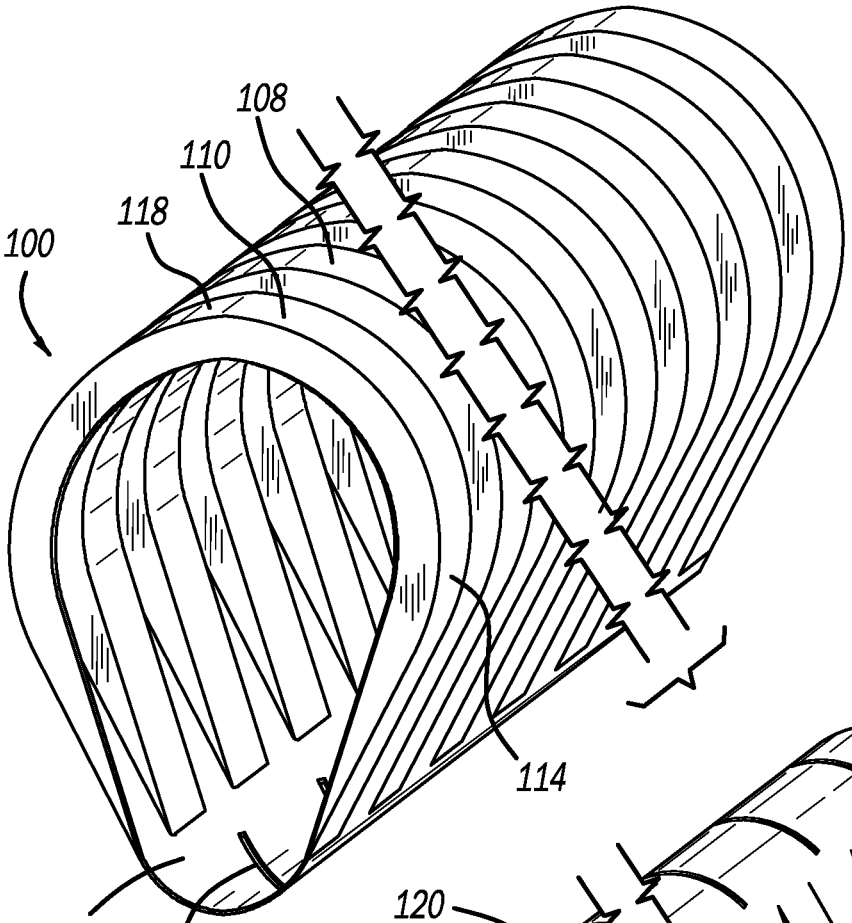
FIG. 1 is a top perspective view of a drainage channel of the present disclosure.

The following description of technology is merely exemplary in nature of the subject matter, manufacture, and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9,1-8,1-3,1-2,2-10, 2-8,2-3,3-10,3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms.

These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present technology provides a drainage channel 100 that can effectively and efficiently drain groundwater and is shown generally in the accompanying FIGS. 1-8.

Figure 2:
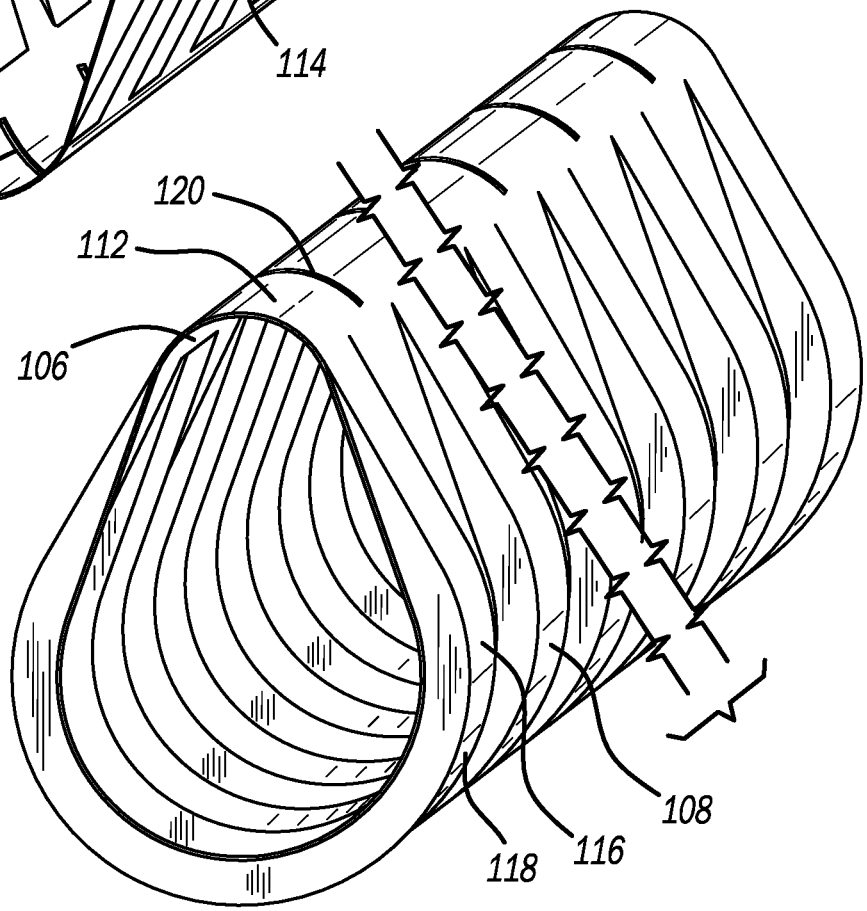
FIG. 2 is a bottom perspective view thereof.
Figure 4:
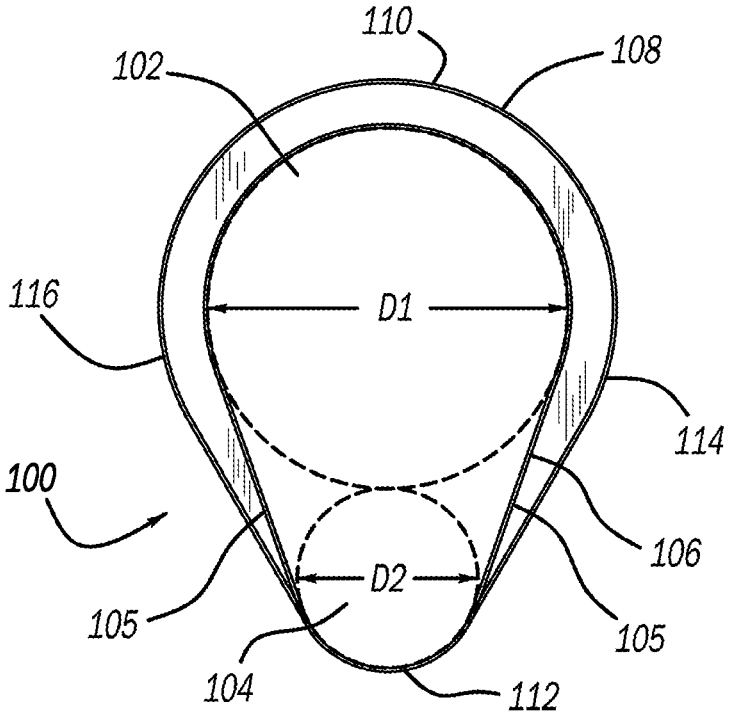
FIG. 4 is a front elevational view thereof.
Figure 5:
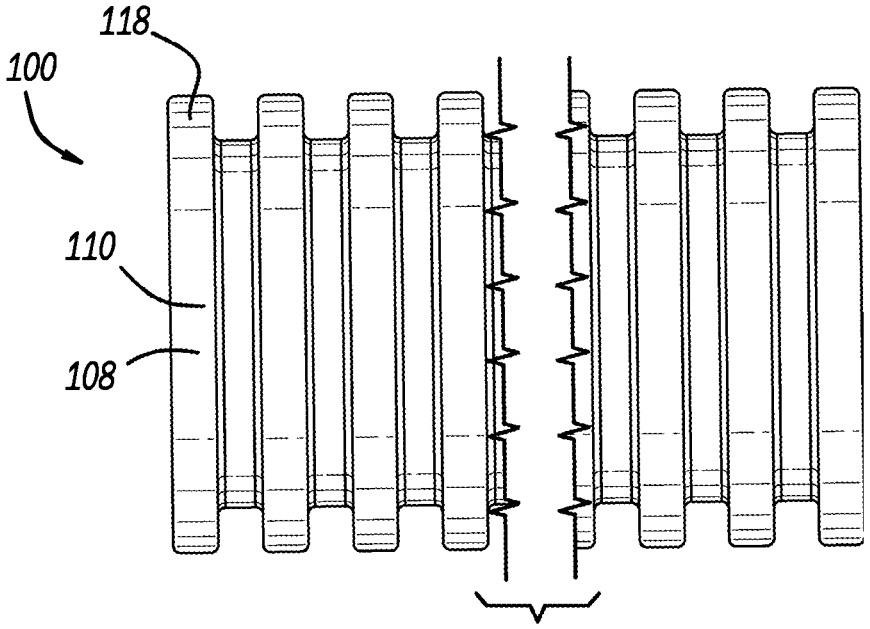
FIG. 5 is a top plan view thereof.

As shown in FIGS. 1-2, the drainage channel 100 can include a substantially polygonal cross-section, where the substantially polygonal cross-section be formed by three or more connected line segments, but where the line segments can include curved lines. Examples further include where the substantially polygonal cross-section can include line segments joined by rounded corners or edges. More specifically, the cross-section of the drainage channel 100 can be formed to resemble a "upside-down pear." In other words, the drainage channel 100 can have a general shape that, as shown in FIG. 4, can be created by first placing two circles, a top circle 102 and a bottom circle 104, of different diameters on top of one another. The top circle 102 can have an internal first diameter (D1) and the bottom circle 104 can have an internal second diameter (D2). In order to create the "upside-down pear" shape, the first diameter (D1) can be larger than the second diameter (D2), resulting in the top circle 102 being larger than the bottom circle 104. In a preferred embodiment, the first diameter (D1) can be about double the second diameter (D2). The two circles 102, 104 can then be connected with two tangential lines 105*s*, one on each side. The shape that is created therefore can define the internal shape of the drainage channel 100.

As a non-limiting example, the first diameter (D1) can range from about 2 inches to about 18 inches. As disclosed hereinabove, in a preferred embodiment, the first diameter (D1) can be double the second diameter (D2) therefore using a dimension ratio of 2:1. As such, the second diameter (D2) can be less than about 18 inches to allow for the first diameter (D1) to be less than the second diameter (D2). More specifically, the first diameter (D1) can be about 3 inches and the second diameter (D2) can be about 1.5 inches. Most particularly, the first diameter (D1) can be about 4 inches and the second diameter (D2) can be about 2 inches. Further common examples include a first diameter (D1) of about 8 inches and a second diameter (D2) of about 4 inches, a first diameter (D1) of about 10 inches and a second diameter (D2) of about 5 inches, a first diameter (D1) of about 12 inches and a second diameter (D2) of about 6 inches, and a first diameter (D1) of about 18 inches and a second diameter (D2) of about 9 inches. However, those skilled in the art can select a suitable first diameter (D1) and, therefore, a second diameter (D2) less than the first diameter (D1). One of ordinary skill in the art can select a suitable first diameter (D1) and second diameter (D2) such that drainage is optimized within the scope of the present disclosure.

Figure 3:
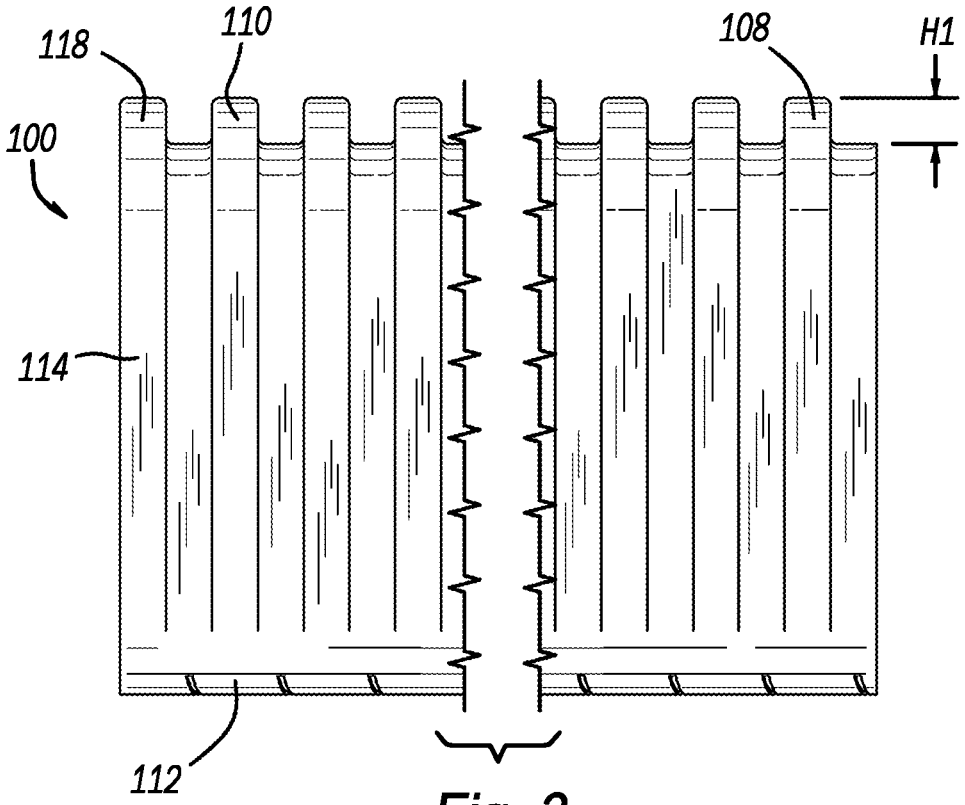
FIG. 3 is a right-side elevational view thereof.

As shown in FIGS. 1-2, the drainage channel 100 can include an inner surface 106 and an outer surface 108. With reference to FIGS. 3-4, the outer surface 108 of the drainage channel 100 can have a top surface 110, a bottom surface 112, and side surfaces 114, 116. The top surface 110 and the side surfaces 114, 116 can contain ribs 118 or corrugation. The ribs 118 can be formed as standard corrugation with a consistent shape throughout the top surface 110 and side surface 114, 116. Alternatively, the ribs 118 can be formed with different dimensions on the top surface 110 and side surfaces 114, 116. In other words, the ribs 118 can have greater depth on one of the surfaces relative to the other. For example, the ribs 118 on the top surface 110 can be all of the same size and depth, while the ribs 118 on the side surfaces 114, 116 can start with a larger depth and gradually decrease the depth of the ribs 118 as the ribs 118 approach the bottom surface 112, such that the ribs 118 can fade into a smooth surface as the ribs 118 near the bottom surface 112. Desirably, the ribs 118 can be used to increase the compressive strength of the material, can allow for rolling the material during manufacturing and installation, and can allow the drainage channel 100 to be bent without kinking.

With reference to FIG. 3, the ribs 118 can extend to a height (H1). As described hereinabove, the ribs 118 can have greater depth on one of the surfaces relative to the other. As such, the height (H1) of the ribs 118 along the top surface 110 can reach the peak height whereas the height of the ribs 118 along the side surfaces 114, 116 can start with a larger depth and gradually decrease as the ribs 118 approach the bottom surface 112. The height (H1) can be small enough to allow for the continuous flow of liquid when necessary but also large enough to maintain flexibility in the drainage channel and prevent collapsing of the drainage channel 100 both during installation and use. As a non-limiting example, the height (H1) of the ribs 118 can be about ⅜ inches where the drainage pipe has a first diameter (D1) of about 3 inches and a second diameter (D2) of about 1.5 inches. As another non-limiting example, the height (H1) of the ribs 118 can be about ½ inches where the drainage pipe has a first diameter (D1) of about 4 inches and a diameter (D2) of about 2 inches. As such, the height of the ribs 118 of the side surface 114, 116 can gradually decrease as the ribs 118 approach the bottom surface 112. One of skill in the art can modify the height, based on the strength of the materials, and can prevent collapsing of the drainage channel 100 both during installation and use.

With continued reference to FIG. 3, the depth of the ribs 118, as disclosed above, can be modified as needed. Those of skill in the art can modulate the depth of the ribs 118 as needed for the intended use of the drainage channel 100. The depth of the ribs 118 can be a function of the strength of the material used to manufacture the drainage channel 100. The depth can be material dependent because, with increased depth of the ribs 118, can be increased internal turbulence. The increased internal turbulence can slow the flow of water, therefore the drainage channel 100 can be formed of a stronger material that can allow more bending in the area of the increased turbulence.

The ribs 118 can be shaped in any configuration known to those of skill in the art. As a non-limiting example, the shape of the ribs 118 can include a U-shape with respect to a cross section along the longitudinal axis, shown in FIGS. 1-6. Advantageously, the shape of the ribs 118 can be varied so as to allow bending during manufacturing and field installation. One of skill in the art can select a suitable rib 118 shape as to allow for the drainage channel 100 to be both flexible and durable.

The ribs 118 can be spaced in any configuration known to those of skill in the art. With reference to FIGS. 1-3 and 5-6, the ribs 118 can be spaced evenly along the length of the drainage channel 100. Desirably, an even spacing of the ribs 118 can allow for the drainage channel 100 to be very flexible for installation. As a non-limiting example, the ribs 118 can be spaced about ⅜ inches apart. In other embodiments, the U-shape of the ribs 118 can allow for the ribs to be spaced unevenly with varying lengths between the ribs 118 along the length of the drainage channel 100. Advantageously, uneven spacing of the ribs 118 can allow for increased stability when the drainage channel 100 is installed in customized spaces such that there are more ribs 118, and therefore more flexibility, at sections of the drainage channel 100 that need to be curved around corners, and less flexibility and therefore, more structure at sections of the drainage channel 100 that are straight.

In an alternative embodiment, the drainage channel 100 can be smooth without ribs. Where the surface of the drainage channel 100 does not contain ribs, the drainage channel 100 can be manufactured of a polymer that eliminates the need for ribs along the drainage channel 100. One of ordinary skill in the art can select a suitable polymer such that the need for ribs is eliminated within the scope of the present disclosure.

As shown in FIGS. 1-3, the outer surface 108 can fade from the corrugated top surface 110 and side surfaces 114, 116 to a smooth bottom surface 112. The smooth bottom surface 112 can allow the drainage channel 100 to sit flush within a trench. This ability can militate against silt and silting from sitting between the corrugated surface of the drainage channel 100 and ground, thereby reducing the flow rate of liquid within the drainage channel 100 and therefore the efficiency of the drainage channel 100. As a result, the smooth bottom surface 112 can allow for laminar flow with minimal turbulence, improve flow rate, and increase velocity.

The inclusion of the ribs 118 on the top surface 110 and side surfaces 114, 116, shown in FIGS. 1-2, can create structural strength in an otherwise weak material and can allow the product to bend without cracking, stretching, or tearing during installation and use. Further, the top surface 110 can be larger than the bottom surface 112. Advantageously, the larger profile of the top surface 110 can allow for a larger volume of water to flow therethrough and can compensate for the additional turbulent flow created by the ribs 118. The shape of the drainage channel 100, along with the smooth bottom surface 112 and corrugated top surface 110 and side surfaces 114, 116, can also ensure proper orientation of the drainage channel 100 within a trench during installation and militate against the drainage channel 100 rotating while within the trench.

As described hereinabove, the bottom surface 112 can be smooth, thereby allowing for laminar flow with minimal turbulence. The smooth bottom surface 112 can improve flow rate and increase water flow velocity. Desirability, this can also help minimize sedimentation build up within the drainage channel. At the same time, the bottom surface 112 can contain drainage apertures, openings, or slots 120 that can allow water to enter the pipe via hydraulic pressure. This incoming water can help suspend any sediment that might enter the drainage channel 100. Since the water can only enter through the bottom surface via hydraulic pressure, the drainage channel can be effectively self-cleaning since sediment drops to the bottom of the drainage channel due to gravity.

Figure 6:
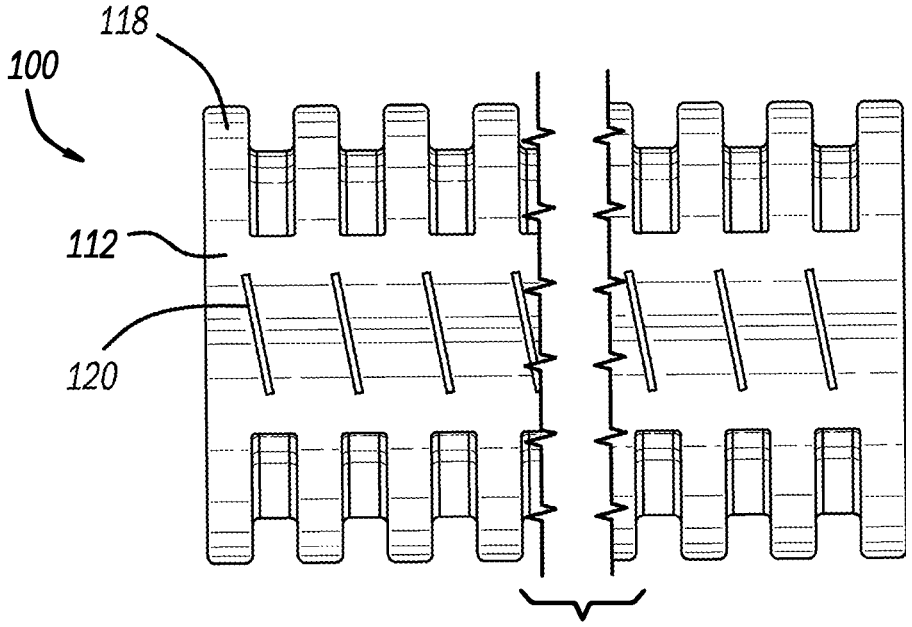
FIG. 6 is a bottom plan view thereof.

The drain holes 120 can be formed as a single unit with the drainage channel 100. The substantially polygonal shape of the drainage channel 100 can ensure that the drainage channel 100 does not rotate during installation and therefore, the drain holes 120 remain on the portion of the drainage channel 100 that is on the bottom. The drain holes 120 can be sized to militate against debris and sedimentation, such as silt or clay, entering the drainage channel 100. The drain holes 120 can be spaced at a distance such that the laminar flow of the liquid in the drainage channel 100 is not disturbed. The size and spacing of the drainage holes 120 can vary depending on soil types as can be readily understood and adjusted by one of skill in the art. As a non-limiting example, the drain holes 120 can be circular, oblong, or rectangular in shape, as shown in FIGS. 1-2 and 6. One of skill in the art can select a suitable shape for the drain holes 120 such that drainage is optimized.

With reference to FIGS. 7A-7C, the drainage channel 100 can also include a connector-check valve 122. The connector-check valve 122 can be used to reduce the runoff of fertilizers and manure into streams, rivers, and lakes. The connector-check valve 122 can be used to join the drainage channel 100 to a main drainage channel and/or a sub-main drainage channel, as represented by main drainage channel 126. The connector-check valve 122 can also include a check valve 124 having a ball, as shown in FIGS. 7A-7C, therefore if the main or sub-main drainage channel 126 is full of water, no water can flow from the lateral into the mains. The check valve 124 can a first position (A) and a second position (B). In the first position (A), the check valve 124 can be open to allow for the drainage channel 100 to drain into the main drainage channel 126. In a second position (B) the main drainage channel 126 can fill and cause the check valve to close off access to the drainage channel 100. In the second position (B) flow from the main drainage channel 126 to the drainage channel 100 and flow from the drainage channel 100 to the main drainage channel 126 can be stopped. In other words, the water flow can be stopped by plugging the main outlet of the drainage channel 100. Currently, plugging water main outlets will not stop water flow. Since water seeks its own level, water will flood low lying areas via the drainage pipe with water from higher ground. Therefore, the drainage channel 100 and check valve connector 122 of the present disclosure can help solve this problem.

Figure 8:
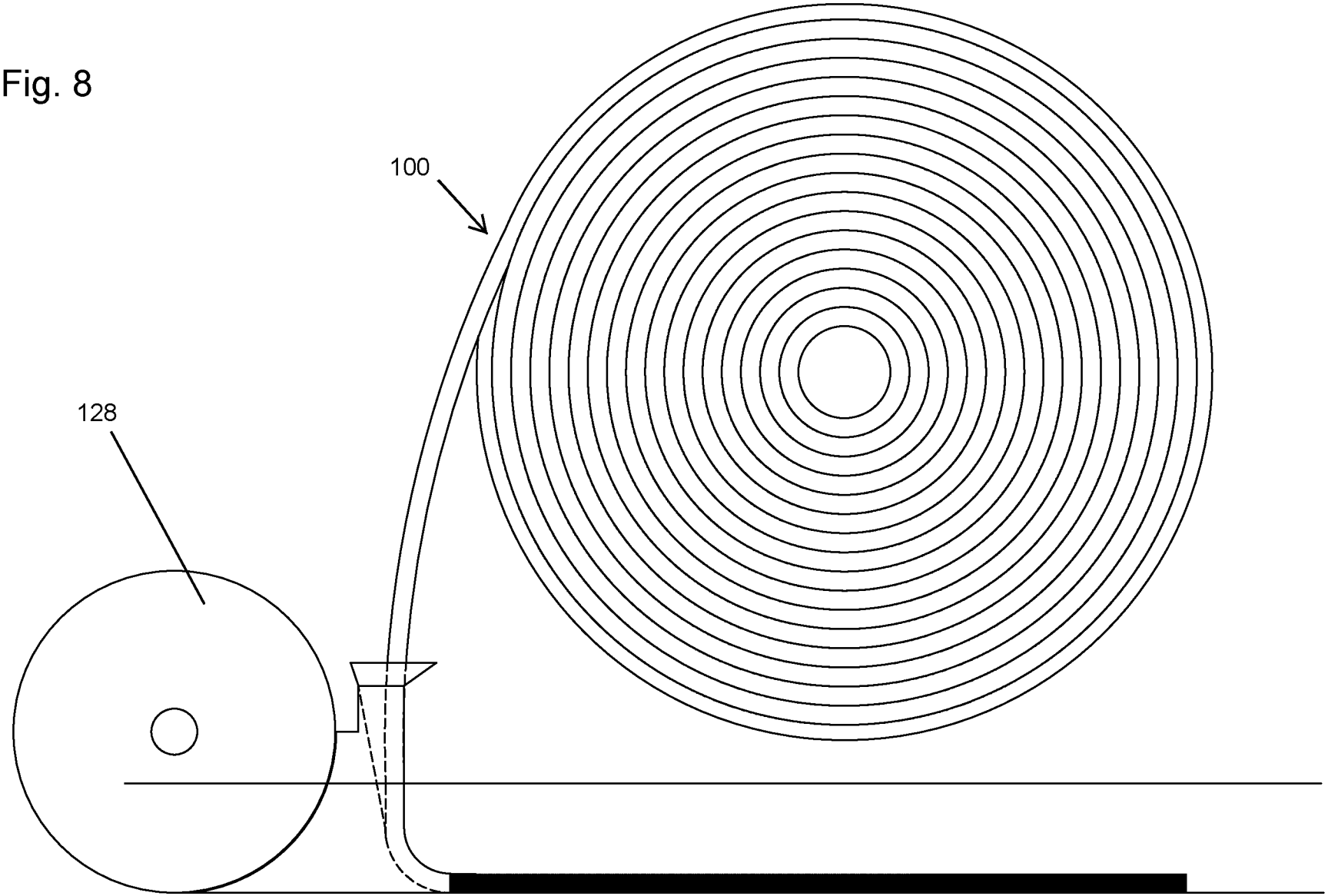
FIG. 8 shows the method of installing the substantially polygonal drainage channel according to one embodiment of the present disclosure.
Figure 9:
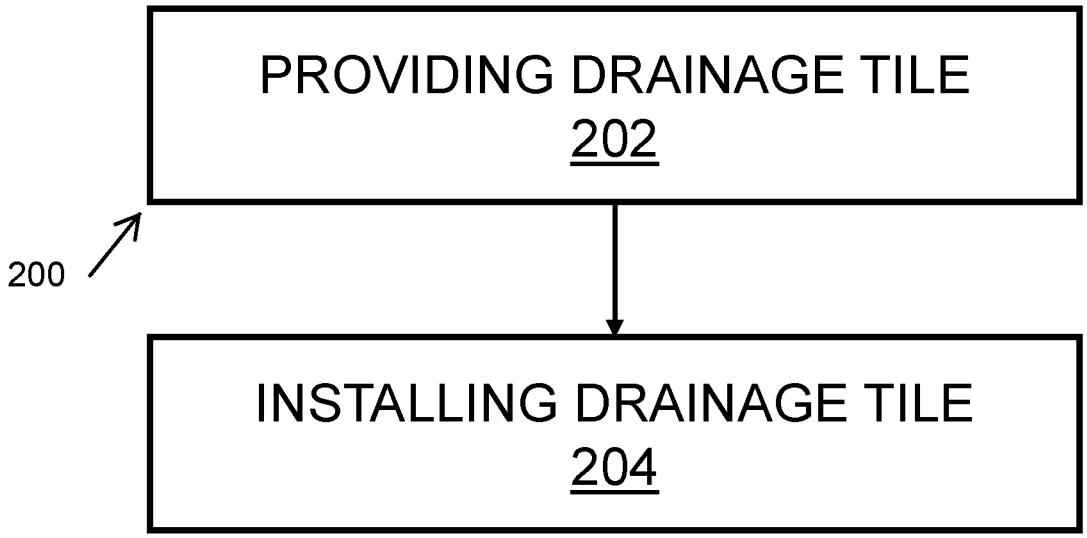
FIG. 9 is a flow diagram illustrating a method of installing a drainage channel.

The drainage channel 100 can be manufactured using the same technology as currently used for forming corrugated pipe. The drainage channel 100 can be manufactured by injection molding plastic, via an extruder, into a moving set of dies that form the outside wall of the desired shape. The product can then be cooled, usually with water. After the drainage channel 100 is formed, the drainage holes 120 can be formed onto the bottom surface of the drainage channel 100. The drainage channel 100 can then be rolled up into a roll containing the amount of drainage channel needed, as shown in FIG. 8. The drainage channel 100 can be formed from any rigid material. Examples of materials that can be used for forming the drainage channel can include high density polyethylene (HDPE), types of polyvinyl chloride (PVC), acrylonitrile butadiene styrene (ABS) and other plastics as known to those of skill in the art.

The drainage channel 100 can be installed at a set depth and grade depending on field contour. One end of the drainage channel can be connected to a main drainage channel 126 with a specially designed connector as shown in FIGS. 7A-7C. The other end can be capped as to not allow water escape or for soil to enter. Spacing and depth of the installation can vary. As a non-limiting example, however, 20' spacing at 20" cover can be used in certain embodiments. One of skill in the art can select suitable spacing and depth for installation of the drainage channel.

Any method known to those of skill in the art can be used for installing the drainage channel 100. One non-limiting example can include installation using a wheel machine 128, shown in FIG. 8. The wheel machine 128 can create a trench profile that is that similar to that of the drainage channel 100 itself. This can be done to create a good fit for the drainage channel 100 as to not damage the product and to orient the drainage holes 120 properly. This can also protect the drainage channel 100 from collapse if someone were to drive over the newly installed drainage channel 100, as can happen when using a tile plow because the plow creates a loose V-shaped (with chunks) soil profile that then can move, thereby crushing the drainage channels 100 of the prior art.

The present disclosure further contemplates a method 200 for installing a drainage channel 100. In a step 202, a drainage channel can be provided. The drainage channel 100, as described hereinabove, can include a substantially polygonal cross section, a top surface 110, a plurality of side surfaces 114, 116 and a plurality of ribs 118 formed on the top surface 110 and the plurality of side surfaces 114, 116. A bottom surface 112 can include a plurality of drainage holes 120. In a step 204, the drainage channel 100 can be installed with the bottom surface 112 oriented down in the ground.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A drainage channel comprising:

a main body having an upside-down pear-shaped cross section with a hollow interior having an interior top surface and an interior bottom surface, the hollow interior defined by two circular areas of different diameters stacked vertically and connected by two straight lines extending tangentially from each of the two circular areas, the two straight lines including a first straight line and a second straight line, the two circular areas including a top circular area, and a bottom circular area, the top circular area having a first diameter, and the bottom circular area having a second diameter, and the second diameter being smaller than the first diameter;

the main body further having a top surface, a first side surface, a second side surface, and a bottom surface, wherein the bottom surface is smooth, the top surface having a top curvature across a width of the top surface corresponding to the interior top surface that is defined by the first diameter of the top circular area, the first side surface being straight along a height of the first side surface and connecting the top surface and the bottom surface, the second side surface disposed opposite the first side surface and being straight along a height of the second side surface and connecting the top surface and the bottom surface; and the bottom surface having a bottom curvature across a width of the bottom surface corresponding to the interior bottom surface that is defined by the second diameter of the bottom circular area, the main body including a plurality of drainage holes formed through the main body in the bottom surface of the main body, the drainage holes having a size and a shape configured to militate against debris and sedimentation entering the hollow interior of the main body, and the drainage holes also spaced at a distance so as to minimize a disturbance to laminar flow within the hollow interior of the main body, and water can only enter the hollow interior of the main body through the drainage holes in the bottom surface via hydraulic pressure, and the main body further having a plurality of ribs formed on the top surface and the first and second side surfaces, the ribs providing flexibility to the drainage channel along a length of the drainage channel.

2. The drainage channel of claim 1, wherein the first diameter is about double the second diameter.

3. The drainage channel of claim 1, wherein the plurality of ribs is uniform.

4. The drainage channel of claim 1, wherein plurality of ribs is not uniform.

5. The drainage channel of claim 1, wherein each rib is U-shaped.

6. The drainage channel of claim 1, wherein the plurality of ribs is evenly spaced along the drainage channel.

7. The drainage channel of claim 1, wherein the plurality of ribs is unevenly spaced along the drainage channel.

8. The drainage channel of claim 1, wherein the plurality of drainage holes includes rectangular drainage holes.

9. The drainage channel of claim 1, wherein the drainage channel further includes a connector-check valve.

10. The drainage channel of claim 9, wherein the connector-check valve is configured to couple the drainage channel with a second drainage channel.

11. The drainage channel of claim 10, wherein the check valve is configured to stop a flow from the drainage channel to the second drainage channel when the second drainage channel is full.

12. A method of installing a drainage channel, comprising:

providing the drainage channel of claim 1; and installing the drainage channel with the bottom surface oriented down.

* * * * *